US006843261B2

(12) United States Patent
Gillis

(10) Patent No.: US 6,843,261 B2
(45) Date of Patent: Jan. 18, 2005

(54) LIGHTWEIGHT FLEXIBLE FRAME FOR SHELTER STRUCTURE

(75) Inventor: Robert E. Gillis, 224 W. O'Connor, Menlo Park, CA (US) 94025

(73) Assignee: Robert E. Gillis, Menlo Park, CA (US)

( * ) Notice: Subject to any disclaimer, the term of this patent is extended or adjusted under 35 U.S.C. 154(b) by 0 days.

(21) Appl. No.: 09/920,080

(22) Filed: Jul. 31, 2001

(65) Prior Publication Data

US 2003/0024564 A1 Feb. 6, 2003

(51) Int. Cl.[7] ..... E04H 15/54; E04H 15/56; E04H 15/64; E04H 15/36; E04H 15/48

(52) U.S. Cl. ..... 135/156; 135/147; 135/124; 135/115; 135/116; 135/119

(58) Field of Search ..... 135/156, 87, 121, 135/124, 137, 127, 126, 125, 128, 143, 906, 147, 115, 116, 119

(56) References Cited

U.S. PATENT DOCUMENTS

| | | | | |
|---|---|---|---|---|
| 1,264,078 A | * | 4/1918 | Jaureguy | 135/118 |
| 3,051,185 A | * | 8/1962 | Reynolds | 135/115 |
| 3,314,630 A | | 4/1967 | Lewis, Sr. | |
| 3,749,107 A | | 7/1973 | Laberge | |

(List continued on next page.)

FOREIGN PATENT DOCUMENTS

| | | |
|---|---|---|
| DE | DT 2521913 | 11/1976 |
| GB | 1103575 | 5/1965 |

OTHER PUBLICATIONS (5) Sierra Designs Catalogs depicting tents and connectors, Sierra Designs, 1255 Powell Street, Emeryville, California 94608 (1987, 1991, 1992, 1995,).

(1) Recreational Equipment Inc. Catalog depicting tents and connectors, 1700 45th Street East, Sumner, Washington 98390 (1994).

Mountain Hard Wear Catalog, pp. 6–15 depicting tents and connectors, 950 Gilman Street, Berkeley, California 94710, publication date unknown.

(2) The North Face brochures, pp. 8–17 and pp. 30–37, The North Face, 999 Harrison Street, Berkeley, California 94710 (1994).

Mountain Hard Wear Catalog, p. 23 depicting tents and connectors, 950 Gilman Street, Berkeley, California 94710 (2001).

L.L. Bean Outdoors Summer Catalog, p. 7, depicting tents and connectors, L.L. Bean Inc. Freeport, ME 04033–0001 USA (2001).

Kelty Catalog, pp. 26–27 depicting tents and connectors, 6235 Lookout Rd, Boulder, Colorado 80301 (1999).

Sierra Designs Spring Tents Catalog, pp. 8–9 depicting tents and connectors, Sierra Designs, 2039 Fourth Street Berkeley, CA 94710 (1992).

Sierra Designs Spring Workbook Catalog, pp. 16–17 depicting tents and connectors, Sierra Designs, 2039 Fourth Street Berkeley, CA 94710 (1992).

*Primary Examiner*—Carl D. Friedman
*Assistant Examiner*—Jennifer E. Novosad
(74) *Attorney, Agent, or Firm*—Townsend and Townsend and Crew LLP

(57) ABSTRACT

A flexible shelter structure has an elongated flexible main pole having first and second ends terminating in a substantially common plane, such as the ground or a base. The pole typically assumes a substantially arcuate shape under tension. A plurality of spars are connected to the pole in a flexible floating arrangement to form a flexible frame. The spars typically assume a generally arcuate shape under tension but their ends do not terminate in the common plane. A membrane is connected to the flexible frame to tension the main pole and the spars and define a substantially sheltered space.

12 Claims, 3 Drawing Sheets

U.S. PATENT DOCUMENTS 3,834,410 A 9/1974 Leibel
3,863,659 A 2/1975 Gillis
3,892,094 A * 7/1975 Spray ..... 135/125
3,986,519 A 10/1976 Gillis
4,049,287 A * 9/1977 Dudouyt ..... 280/213
4,099,533 A 7/1978 Gillis
4,175,305 A 11/1979 Gillis
4,265,259 A 5/1981 Gillis
4,265,260 A 5/1981 Gillis
4,308,647 A 1/1982 Gillis
4,414,993 A 11/1983 Gillis
4,494,558 A * 1/1985 Fidler, Jr. ..... 135/117
4,706,696 A 11/1987 Gillis
4,809,726 A 3/1989 Gillis
4,944,322 A 7/1990 Gillis
5,301,705 A * 4/1994 Zheng ..... 135/125
5,388,311 A 2/1995 Solbeck
5,477,876 A 12/1995 Moss
5,572,945 A * 11/1996 Eastaugh ..... 116/173
5,642,750 A 7/1997 Brown
5,871,026 A 2/1999 Lin
5,887,774 A * 3/1999 Bethune ..... 224/414
5,887,841 A * 3/1999 Newberg ..... 248/519
5,927,311 A * 7/1999 Jager ..... 135/124
5,950,649 A * 9/1999 Gerig ..... 135/124
5,971,414 A * 10/1999 Borzage ..... 280/213
6,082,385 A * 7/2000 Burford et al. ..... 135/116
6,140,576 A * 10/2000 Kanne et al. ..... 135/136
6,145,527 A 11/2000 Gillis
6,227,557 B1 * 5/2001 Perret ..... 135/88.01
6,266,932 B1 * 7/2001 Van Tassel ..... 135/124
6,302,127 B1 * 10/2001 Gayton ..... 135/117
6,345,638 B1 * 2/2002 Warner ..... 135/123
6,371,144 B1 * 4/2002 Ragatz ..... 135/115
6,431,193 B2 * 8/2002 Carter ..... 135/120.3
6,450,187 B1 * 9/2002 Lin et al. ..... 135/114

* cited by examiner

LIGHTWEIGHT FLEXIBLE FRAME FOR SHELTER STRUCTURE

BACKGROUND OF THE INVENTION

This invention relates to flexible shelter structure such as tents and the like.

It is desirable in many flexible shelter structures to maximize the volume of the sheltered space defined by the structure, while at the same time maximizing the strength of the structure and minimizing its weight. These are particularly desirable characteristics in tents designed for mobile applications, such as backpacking.

Numerous flexible shelter and tent designs are described in the prior art. For example, various convex multi-poled tent structures are described in U.S. Pat. Nos. 3,986,519, 4,099,533, 4,265,260, and 4,414,993, all of which are owned by the inventor of the present invention. U.S. Pat. Nos. 3,986,519 and 4,099,533 both disclose dome-like structures composed of a plurality of flexible pole or rod elements maintained under tension in a generally arcuate shape, and an underlying membrane. Each structure includes at least two intersecting sets of such pole or rod elements. The rod or pole elements are held in fixed relationship at intersections by fittings secured to the underlying flexible membrane or sheath. The underlying membrane or sheath acts as a tension member to maintain the poles under tension.

U.S. Pat. Nos. 4,265,260 and 4,414,993 disclose a flexible vault structure which similarly includes a plurality of deformable resilient poles that are held under tension in generally arcuate shape by an underlying fabric member. U.S. Pat. No. 4,265,260 discloses the use of fabric sleeves in addition to fittings for coupling the poles to the underlying fabric member. This structure similarly lacks the added rigidity and strength of the structure of the present invention, which includes additional tension elements.

Each of the foregoing structures employ a plurality of flexible, resilient poles, the opposite ends of which terminate in a common plane or base, e.g., the ground. The poles add weight to the overall structure. Additionally, since the poles are typically maintained in a generally arcuate shape under tension, the arch of the poles essentially determines and limits the volume of the internal sheltered space of the structure. The materials used to manufacture the poles can also be quite expensive.

What is needed and what has been devised is a flexible shelter structure employing one or more flexible main poles, in which the sheltered space defined by the structure is not limited by the arcuate shapes of the main poles and may in fact be significantly increased, and in which the amount of pole material is reduced, thereby significantly reducing the weight and cost of the structure.

BRIEF SUMMARY OF THE INVENTION

The present invention comprises a flexible shelter structure having an elongated flexible main pole with first and second ends, which terminate in a common plane. A plurality of spars are flexibly connected to the pole to form a flexible frame structure. One or more of the spars may be substantially transverse to the pole and one or more spars may have first and/or second ends that do not terminate in the common plane, but that float. A membrane may be flexibly connected to the flexible frame structure either over the pole and spars, intermediate the pole and spars, or both. The membrane defines a substantially sheltered space.

DETAILED DESCRIPTION OF THE INVENTION

Figure 1:
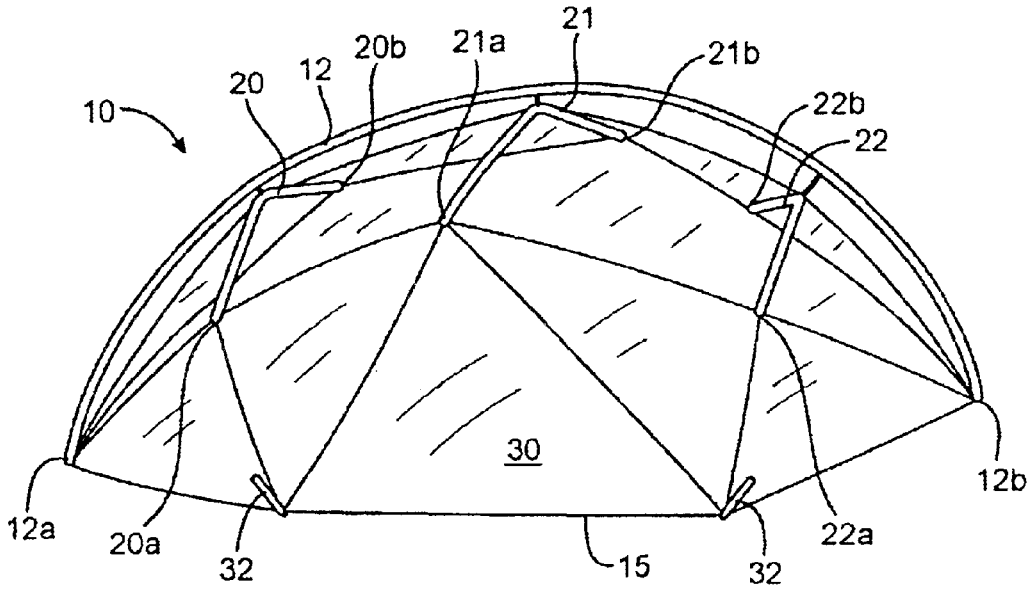
FIG. 1 is a side perspective view of a flexible shelter structure embodying the present invention.

Presently preferred embodiments of the invention will now be described in detail with reference to the drawings, wherein similar parts are identified by like reference numerals.

Figure 2:
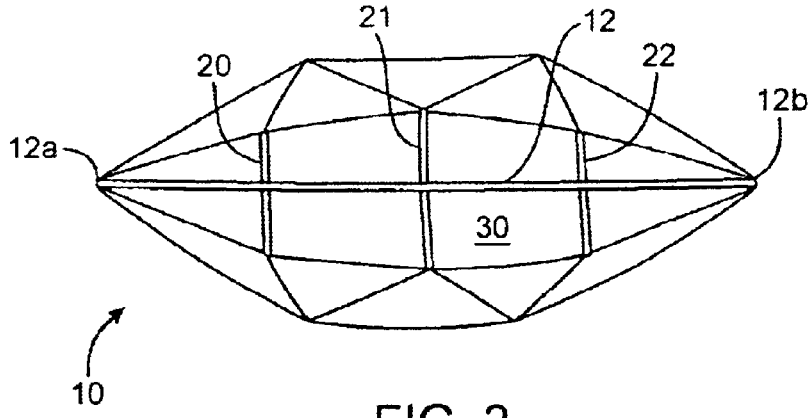
FIG. 2 is a top plan view of the flexible shelter structure illustrated in FIG. 1.

Referring to FIGS. 1 and 2, the invention is shown embodied in a first preferred flexible structure 10. The flexible structure 10 of the present invention may be used for any suitable purpose, such as a shelter, storage space, dwelling, tent, or the like. A particularly useful application is as a tent and the structures described herein may be referred to from time to time as tents. However, such references are merely exemplary and are not intended to be limiting.

Flexible structure 10 has a main pole 12. Main pole 12 is elongated, is preferably flexible and resilient and has termini or terminal ends 12*a* and 12*b*. The main pole may be continuous or may be formed in segments. For example, the main pole may have multiple segments with cooperating fittings and be held together by well known shock cord techniques.

The main pole may be any of the well known pole types typically used in known tent structures. These include single and multi-piece poles made of aluminum, fiberglass, graphite, or other suitable materials which are flexible and resilient.

In use, the main pole is preferably flexed under tension in a generally arcuate shape. The terminal ends 12*a* and 12*b* preferably terminate in a common plane, such as the ground or a base 15.

A plurality of floating spars 20, 21, 22 are flexibly connected to the main pole 12 at spaced locations along its length. Preferably, the spars are arranged substantially transversely to the main pole. The spars, like the main pole 12, have first and second terminal ends 20*a*, 20*b*, 21*a*, 21*b*, 22*a*, and 22*b*respectively. The spars are referred to as "floating" since one or both terminal ends of one or more of the spars does not terminate in the common plane, like the terminal ends of the main pole 12, but instead remains essentially unconnected or unattached. In the preferred embodiment illustrated, each of the terminal ends of each of the spars is shown unconnected and floating.

The spars may be made of the same material as the main pole. The spars may be initially straight flexible segments of pole material, or may be pre-flexed or pre-bent in a selected shape, as shown in FIG. 3. Preferably, the spars will flex in a generally arcuate shape when placed under tension. By increasing the radius of curvature of the spars under tension, a sheltered space having increased volume can be obtained without the necessity of adding main poles, increasing the size of the poles, or increasing the footprint of the structure. Thus, the radius of the spars in a structure having a given footprint will generally be greater than the radius of a complete arcuate pole that would otherwise extend over and across structure 10 under tension with its terminal ends terminating in the common plane.

Figure 3A:
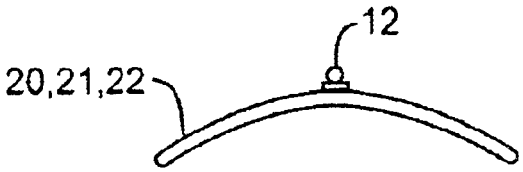
FIGS. 3*a*–3*c* illustrate three alternative arrangements for connecting the floating spars of the present invention to a main pole.
Figure 3B:
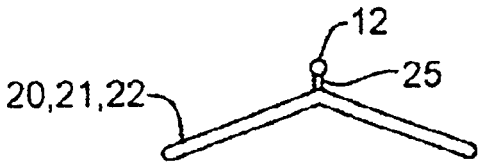
Figure 3C:
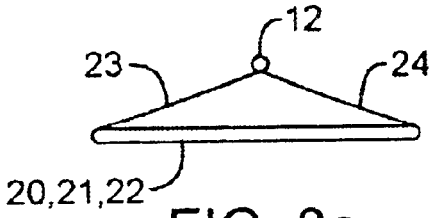

FIGS. 3*a*–3*c* illustrate three alternative arrangements for connecting the spars to the main pole. In FIG. 3*a*, the spar is directly connected to the main pole. This connection is suitably made by riveting, tying, hooking or otherwise flexibly connecting the spar to the main pole. In FIG. 3*b*, the spar is indirectly connected to the pole via a suspension cord 22, or the like. The suspension cord may be attached to the main pole and to the spar in any suitable fashion. The suspension cord stabilizes the arch of the spar in the direction of the main pole. Alternatively, suspension cord 22 can be eliminated by providing pockets to engage the ends of the spar to orient the arch towards the main pole, or if the spar is straight. In each of the arrangements of FIGS. 3*a* and 3*b*, the spar is preferably connected to the main pole at approximately the midpoint of the spar. Also in each of these arrangements, the spar is illustrated in a tensioned condition. In FIG. 3*c* the spar is indirectly connected to the main pole via a pair of tension cord. 23 and 24. Similarly to the arrangements of FIGS. 3*a* and 3*b*, the tension cords 23 and 24 may be connected to the spar and to the main pole in any suitable fashion. Tension cords 23 and 24 may be separate cords, or may be a single contiguous cord that runs through the spar, if the spar is hollow. Unlike the arrangements of FIGS. 3*a* and 3*b*, in this alternative arrangement, if separate tension cords are employed, they are preferably attached to the spar near its terminal ends, such that the spar is maintained beneath the main pole in a balanced tensioned fashion with its center point in or near the plane of the main pole. Tension cords 23 and 24 may also be replaced by portions of a membrane, such as sleeves, pockets, or the like for engaging and tensioning the spar.

Returning to FIGS. 1 and 2, the main pole 12 and spars 20, 21, and 22 form a flexible frame structure. A membrane 30 is preferably attached to the flexible frame structure in any suitable fashion, numerous means for connecting such membranes to poles and the like being known to those skilled in the art. The membrane 30 will preferably define a sheltered space for any desired use. "Sheltered" as used herein does not necessarily mean the space must be completely enclosed or even that it must provide complete shelter from external elements. However, the sheltered space should at least be usable for the intended purpose of the structure.

The membrane may or may not include a floor section in the common plane, e.g., the ground, depending on the design and intended use of the flexible shelter. The membrane may be any suitable membrane, skin, film, fabric or the like, such as a plastic sheet material of polyethylene, polypropylene, vinyl and the like, or a woven fabric such as cotton, nylon, or polyester, or any other material, including a material having the characteristics of being stretchable in multiple directions. However, when the flexible shelter structure is intended to function as a tent, the membrane will preferably be a suitable tent fabric.

As illustrated in FIGS. 1 and 2, in one preferred arrangement, the membrane is connected to the spars and is suspended beneath the spars and the main pole. The membrane will also preferably be connected to the terminal ends of the main pole via conventional rings, loops, pockets, or other known means. In this fashion, the membrane tensions the main pole and the spars. The membrane may also be attached to the common plane, such as the ground, via stakes 32 or the like. At the same time, the roughly arcuate shape of the floating spars, increases the volume of the sheltered space without requiring additional main poles or increasing the footprint of the structure.

In another preferred arrangement, a second membrane (not shown) may be connected to the main pole and/or the common plane and overlie the entire structure as a fly. In this arrangement, an air space is created between the underlying and overlying membranes. This air space may provide additional insulation to the sheltered space. The use of multiple membranes also provides additional protection from the elements.

Figure 4A:
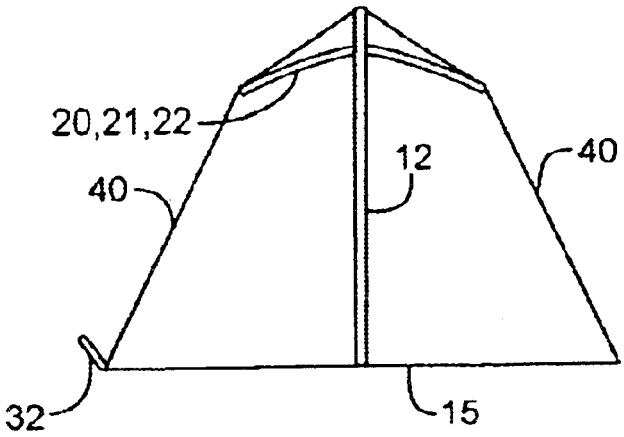
FIG. 4*a* is a cutaway view illustrating an arrangement for providing further stabilization to the flexible shelter structure of FIGS. 1 and 2 in a generally upright configuration.

FIG. 4*a* illustrates a generally upright configuration of the flexible shelter structure of FIGS. 1 and 2, which is suitable for use as a tent or similar shelter. In this configuration, the main pole is maintained in a generally upright configuration, such that the flexible shelter structure itself is in a generally upright configuration. In this configuration, it may be desirable to further stabilize the structure using one or more guy lines 40. Preferably the guy lines will connect to the common plane and to the membrane or the spars themselves. Also preferably, the guy lines are of an adjustable length so that they can be used to not only further stabilize the structure, but also center it if desired so that it does not lean to one side. Suitable adjustable guylines are well know to those skilled in the art. The guylines may be in the form of a membrane and also serve as the walls of the structure.

Figure 4B:
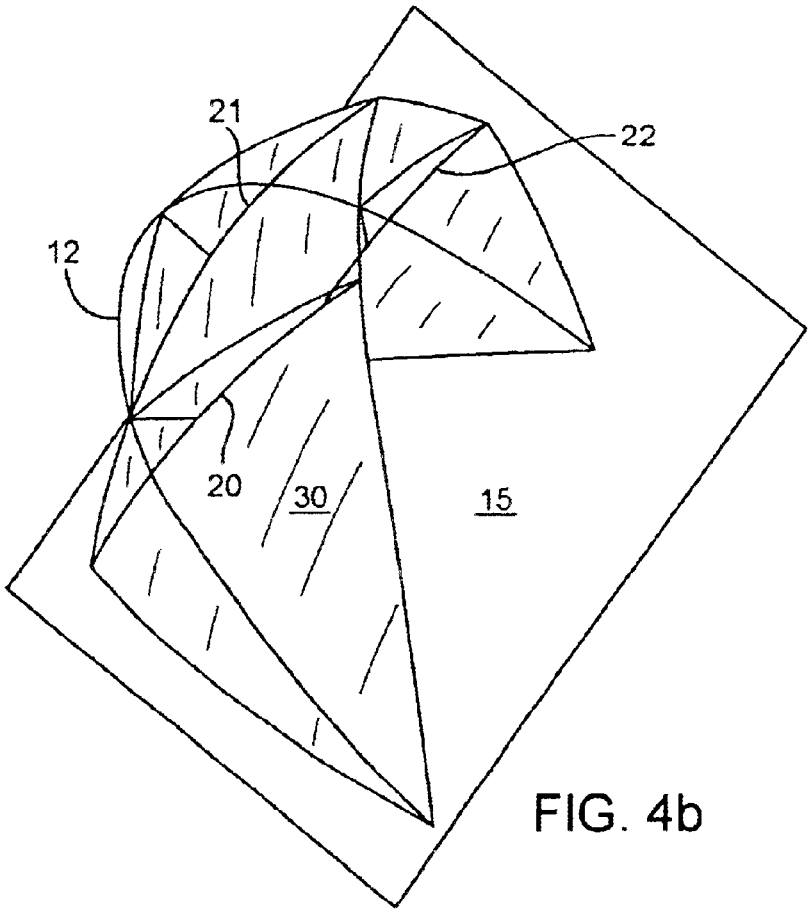
FIG. 4*b* is a perspective view illustrating an alternative configuration of the flexible shelter structure of FIGS. 1 and 2.

FIG. 4*b* illustrates the structure in an alternative leaning configuration. In this configuration, corresponding ends of the spars are in contact with the common plane and the main pole forms a plane at an angle less than about 90 degrees to the common plane. The opposite ends of the main pole still terminate in the common plane. The opposite ends of the spars remain floating. The structure can be staked into position in this configuration to provide a lean-to, wind shelter, or the like.

Figure 5:
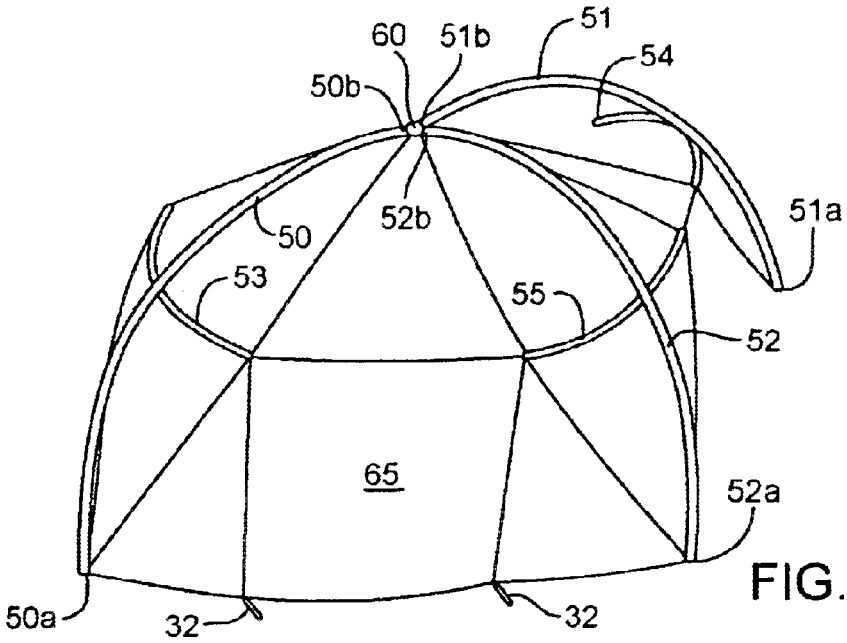
FIG. 5 is a perspective view illustrating another preferred embodiment of a flexible shelter structure embodying the present invention.

FIG. 5 illustrates another preferred embodiment of the invention. In this embodiment, a flexible frame structure is comprised of a plurality of main poles 50, 51, 52, and a plurality of spars 53, 54, 55, each spar being connected to a corresponding main pole. The main poles each have first and second terminal ends 50*a* and 50*b*, 51*a* and 51*b*, and 52*a* and 52*b* respectively. A first corresponding set of ends 50*a*, 51*a*, and 52*a* terminate in the common plane, e.g. the ground. The second opposite set of corresponding ends 50*b*, 51*b*, and 52*b* extend upwardly from the common plane and are joined together via a three way hub 60 or similar conventional fixture. The main poles are tensioned so that each assumes a substantially arcuate shape. Each of the spars is preferably arranged substantially transversely to its corresponding main pole. The spars are positioned along the length of their respective main poles depending on the desired volume and shape of the sheltered space being created. However, for best stability and space volume, the spars are preferably spaced approximately mid-way between the opposite ends of their respective man poles. A membrane 65 is connected in conventional fashion to the spars and the three way hub, or the poles in the vicinity of the three way hub in order to define a sheltered space. The membrane may be affixed to the common plane by stakes or the like and to the ends of the poles that terminate in the common plane via rings, loops or the like to tension the membrane and hence the main poles and spars.

The present invention has been described herein with reference to particular presently preferred embodiments thereof. However, those skilled in the art will appreciate that a variety of modifications, changes, and substitutions may be made while retaining the features and advantages of the invention and without departing from its spirit. For example, various modifications may be made in materials, shapes and sizes of various components. Further, depending upon the desired shape, volume and usage of the flexible structure being constructed, one or more main poles or main pole segments may be used. The number of spars per main pole may also be modified as desired or necessary. The arrangement and configurations of the main poles and of the spars may be modified to construct flexible frame structures and flexible shelter structures having various shapes. Accordingly, it is intended that the invention not be limited to the particular embodiments disclosed, but that it include all embodiments and equivalents falling within the scope of the appended claims.

What is claimed is:

1. A flexible shelter structure comprising:

an elongated flexible pole under tension in a generally arcuate shape and having a first end and a second end, said first and said second end each in contact with the ground;

a plurality of flexible spars each having a first end and a second end, each said spar flexibly connected to said pole at a point on said pole intermediate said first and said second end of said pole, and at a point on said spar intermediate said first and said second end of said spar, each said spar crossing said pole at an angle and being spaced apart relative to other spars along the length of said pole, said first and said second end of each said spar floating and not in contact with the ground, said spars being under tension in a generally arcuate shape with a radius of curvature greater than that of said elongated flexible pole, said pole and said spars thereby forming a flexible frame structure; and a membrane connected to said flexible frame structure and defining a substantially sheltered space thereunder, said sheltered space having a volume dependent on said radius of curvature of said spars.

2. The flexible shelter structure of claim 1 wherein said membrane tensions said pole and said spars.

3. The flexible shelter structure of claim 1 wherein said spars cross said elongated flexible pole at a substantially transverse angle.

4. The flexible shelter structure of claim 1 wherein said spars are directly connected to said elongated flexible pole.

5. The flexible shelter structure of claim 1 wherein said spars are pre-bent in a selected shape.

6. The flexible shelter structure of claim 1 including a tensioning means in communication with said elongated flexible pole to place said pole under tension to cause said pole to flex in said substantially arcuate shape.

7. The flexible shelter structure of claim 1 wherein said membrane is connected to said flexible frame structure intermediate said pole and said spars.

8. The flexible shelter structure of claim 1 wherein said membrane is connected to said flexible frame structure intermediate said pole and said spars, and wherein a second membrane is connected to said flexible frame structure over said pole and said spars, thereby forming a space between said membrane and said second membrane.

9. The flexible shelter structure of claim 1 wherein said elongated flexible pole comprises a plurality of interconnected pole segments.

10. The flexible frame structure of claim 1 wherein one or more of said spars are indirectly connected to said pole.

11. The flexible shelter structure of claim 1 including a guy line having a first end connected to a said spar, and a second end connected to the ground, said guy line maintaining said flexible frame structure in a substantially upright position.

12. The flexible shelter structure of claim 1 wherein said membrane is connected to said spars, extends substantially to the ground, and maintains said flexible frame structure in a substantially upright position.

* * * * *

UNITED STATES PATENT AND TRADEMARK OFFICE

CERTIFICATE OF CORRECTION

PATENT NO. : 6,843,261 B2
DATED : January 18, 2005
INVENTOR(S) : Robert E. Gillis It is certified that error appears in the above-identified patent and that said Letters Patent is hereby corrected as shown below:

Column 2,
Line 58, delete "… and 22*b*respectively ..." and insert -- ...and 22*b* respectively... --.

Column 3,
Line 18, delete "...22, or the like." and insert -- ...25, or the like... --.
Line 21, delete "Alternatively, suspension cord 22 can..." and insert
-- Alternatively, suspension cord 25 can... --.

Column 4,
Line 29, delete "Suitable adjustable guylines are well known to" and insert
-- Suitable adjustable guy lines are well known to --.
Line 30, delete "The guylines may be..." and insert -- The guy lines may be... --.
Line 60, delete "...respective man poles." and insert -- ...respective main poles. --.

Signed and Sealed this

Twenty-eighth Day of February, 2006

JON W. DUDAS
*Director of the United States Patent and Trademark Office*